United States Patent [19]

Karey et al.

[11] Patent Number: 4,757,183

[45] Date of Patent: Jul. 12, 1988

[54] PORTABLE CORDLESS ELECTRIC HAIR DRESSING APPLIANCE UTILIZING STORED HEAT

[75] Inventors: Hans Karey, Steinbach/Ts.; Anette Berg, Liederbach, both of Fed. Rep. of Germany

[73] Assignee: Braun Aktiengesellschaft, Kronberg, Fed. Rep. of Germany

[21] Appl. No.: 865,257

[22] Filed: May 20, 1986

[30] Foreign Application Priority Data

May 22, 1985 [DE] Fed. Rep. of Germany ..... 3518426

[51] Int. Cl.[4] ..... A45D 20/10; F24H 7/04; H05B 3/00

[52] U.S. Cl. ..... 219/365; 34/97; 34/243 R; 219/367; 219/368; 219/370; 219/378; 320/2

[58] Field of Search ..... 219/370, 369, 365, 378, 219/202, 366–368; 320/2; 34/243 R, 96–101

[56] References Cited

U.S. PATENT DOCUMENTS

| | | | |
|---|---|---|---|
| 2,003,496 | 6/1935 | Roe | 219/365 |
| 2,606,274 | 8/1952 | Spierer | 219/365 X |
| 3,377,715 | 4/1968 | Hubmer | 219/370 X |
| 3,391,470 | 7/1968 | Chedister | 320/2 X |
| 3,797,475 | 3/1974 | Hughes | 219/370 X |
| 3,885,126 | 5/1975 | Sugiyama et al. | 219/378 R |

FOREIGN PATENT DOCUMENTS

| | | | |
|---|---|---|---|
| 8300607 | 3/1983 | European Pat. Off. . | |
| 1457415 | 1/1969 | Fed. Rep. of Germany . | |
| 2005984 | 8/1971 | Fed. Rep. of Germany | 219/365 |
| 2753925 | 6/1979 | Fed. Rep. of Germany | 219/202 |
| 3103843 | 2/1982 | Fed. Rep. of Germany . | |
| 1457596 | 9/1966 | France | 219/202 |
| 17076 | of 1914 | United Kingdom | 34/243 R |
| 427085 | 4/1935 | United Kingdom | 219/378 |

*Primary Examiner*—Anthony Bartis

[57] ABSTRACT

A cordless portable hand held hair dressing appliance has a housing provided with a pistol-grip handle and containing a battery operated electric fan arranged to draw air into the housing through an air inlet for flow through a heat structure to be heated prior to discharge from a housing air outlet. The heater structure includes air elongated heat accumulator member of high specific heat penetrated in the longitudinal direction by a plurality of air ducts each having an intake communicating with the housing inlet and an outlet communicating with a mixing chamber connected to the housing outlet. The heat accumulator member is formed of a ceramic, e.g., $Al_2O_3$ and MgO, and is adapted to be heated to store heat therein by an electrical heating conductor structure formed by a layer of electrical resistance material on the wall of each duct. The fan battery is rechargeable and the handle is provided with a detachable electric plug contacts for connecting the heating conductor structure to an external power source for preheating prior to use and for connecting the rechargeable battery to a batter charger.

18 Claims, 3 Drawing Sheets

PORTABLE CORDLESS ELECTRIC HAIR DRESSING APPLIANCE UTILIZING STORED HEAT

Figure 1:
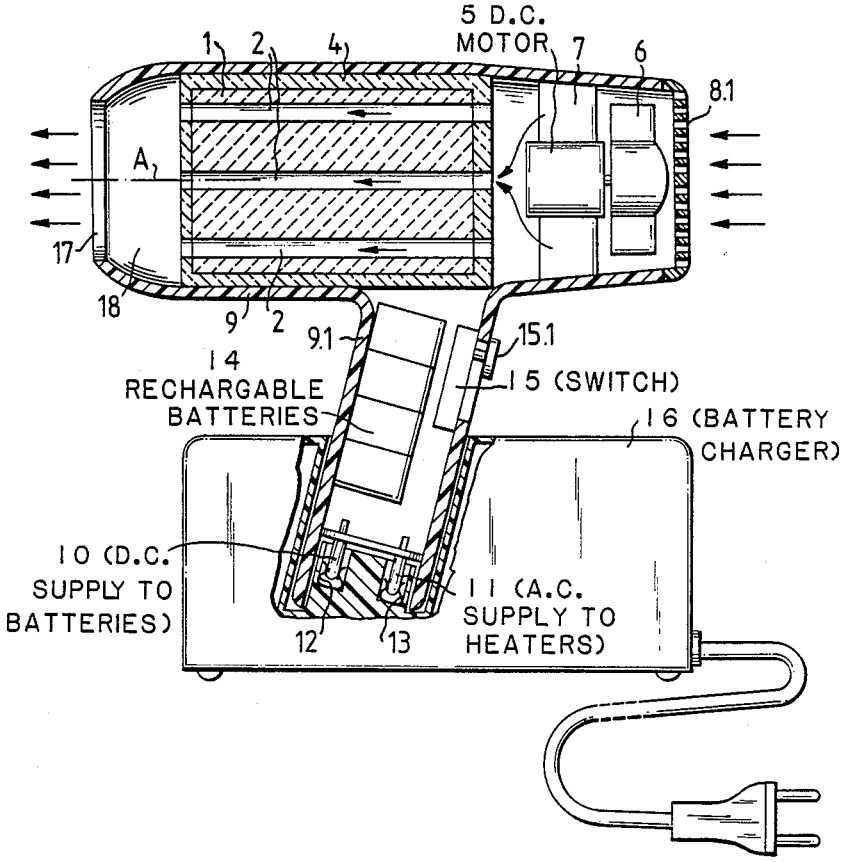

The present invention relates to portable hair dressing appliances of the heated-air fan type.

Apart from conventional heated-air fans operated by power supply and used for instance in electric hand held hair dryers, self-sufficient—that means independent of power supply—usable heated-air fans are known already which contain as a source of heat a gas burner fed by a liquid petroleum gas tank. Thus, a hand held hair dryer is described in German published patent application 31 03 843 in which the gas burns with an open flame, and a corresponding appliance with flameless catalytic combustion is known from the international patent application WO 83/00 607. Moreover, it has been suggested in German published patent application 14 57 415 to produce the heated air for a hair-drying hood in a separate case-type tank with the aid of an electrically heated heat accumulator.

Admittedly, all these known appliances bear the advantage that they can be used without a power cord limiting the user's freedom of movement and that they allow use even at locations where there is no plug socket or where its installation is not permitted due to existing regulations. However, the gas-heated appliances precondition the permanent availability of replenishable liquid gas, and the description of the heat-accumulator fan referred to hereinabove does not contain any technical teachings as to how the heater balance thereof can be improved to such effect that it satisfies the demand for small dimensions and low weight imperative with respect to a portable or even constantly hand held hairdressing appliance.

Therefore, it is the object to provide for a self-sufficiently usable heated-air fan which—without being dependent on liquid gas provision—fulfils the preconditions for being used in hand held hair dryers and other portable hair-dressing appliances as regards its dimensions, its weight as well as its delivery efficiency with regard to the blower and filament wattage.

This object will be achieved according to the present invention by a heated-air fan utilizing a heat-accumulator heater element. Owing to the inventive choice of the heat-accumulator principle, known per se, for heating the fan air and the distribution of the air stream into several—preferably 5 to 10—air ducts penetrating the heat-accumulator heater element, a heated-air fan will be devised which realizes a new type of portable hairdressing appliances in respect to construction and production engineering, and—what is more and remarkable—within the limits of those dimensions nowadays conventional with such appliances.

In a favourable embodiment of this invention, the air ducts of the heater element have an inside diameter of 5 to 10 mms, as a result whereof those favourable values will be obtained that must be demanded from portable hairdressing appliances—in particular from hand held hair dryers—with regard to their flow velocity and their heat transfer and hence their heating element wattage and its timely variation. In addition, the heat balance of the heater element can be optimized according to this invention in that the air ducts are arranged in such fashion that approximately the same quantity of heat-accumulating material is allocated geometrically to each air duct, that is, approximately the same quantity of stored heat is available for heating each air stream. This dimensioning which in general preconditions like cross-sectional surfaces of the air ducts may be varied according to another embodiment to such end that the portions of the accumulator matter allocated to the individual air ducts are proportional to varying cross-sectional surfaces of these air ducts.

In an embodiment of this invention which is advantageous particularly in respect of production engineering, the heater element which is, e.g. composed of any ceremics, such as $Al_2O_3$ and MgO, is subdivided into a number of segments of approximately the same bulk, each containing one air duct, the number of said segments corresponding to the number of said air ducts, with the butt joints between these segments preferably being filled with a compensating matter. This compensating matter avoids, on the one hand, the occurrance of an undefined heat contact between the segments due to unevenness of their abutting surfaces. On the other hand, selecting a more or less heat-conductive filling matter allows influence on the heat balance of the entire heater element.

Furthermore, there is proposed a number of embodiments of this invention by which different flow routes of the heated air can be caused so that the respectively optimal shape may be chosen, while taking into account those demands made on hairdressing appliances to be equipped with heated-air fans. Thus, the flow pattern may for instance be influenced in that, as an alternative of or supplementary to the air ducts usually extending in straight line, there is provision of various helical ducts, and said air ducts may dispose of a cross-section changing—in particular narrowing—from the air intake side to the air outlet side.

The electric heating conductors provided for heating the heater element can extend within the accumulator material, however, preferably, they are arranged along the walls of the air ducts where they are embedded—for instance in the form of wired heating spirals—in the walls of the air ducts during manufacture of the heater elements. It is a special advantage in the present case to design the heating conductors in the shape of layers of electric resistance material applied on the walls of the air ducts, with vapour-deposited resistance layers being especially proposed. Finally, in order to reduce the air flow resistance, the walls of the air ducts may be provided with a smooth surface layer consisting in particular of a varnish or a glaze.

In another expedient embodiment of the inventive heated-air fan, the heat-accumulator heater element is encompassed by a heat-insulating sheath, and at the outer side—within the appliance housing though—there is disposed at least one intake duct which has in particular an annular cross-section enclosing the heater element and through which the cold air sucked in by the fan is directed to the air intake side of the fan in opposition to the direction of flow caused in the air ducts of the accumulator element. This arrangement has as an effect that heating of the outer surface of the heat-insulating sheath, which cannot be avoided in full extent during the heat-up phase, will be utilized for prewarming the sucked-in air when the fan is put into operation.

It is especially feasible to arrange for a mixing chamber between the heater element and the discharge opening of the heated-air fan, into which mixing chamber the air ducts of the heater element terminate and in which turbulence and intimate mixture of the single air streams takes place, with the result that the air stream exiting from the discharge opening of the fan has a uniform temperature distribution over the entire cross-section.

To heat up the heat-accumulator heater element as well as to charge the rechargeable batteries feeding the fan motor, it is advantageous to integrate a plug assembly directly into the fan casing allowing it to be connected to a corresponding plug socket of a power supply unit. It is suitable to provide for two pairs of plug contacts, the first thereof serving to heat up the heater element by means of an alternating current power supply and the second thereof serving to charge the rechargeable batteries by means of an appropriate direct current voltage generated in the power supply unit. It will be insured by constructively designing the plug assembly, on the one side, and the plug socket, on the other side, that these two parts may only be plugged into one another when in the right position so that wrong polarities will be avoided. In the event of the particularly favourable use of the inventive heated-air fan as a hand held hair dryer with a so-termed pistol-grip, the plug assembly at issue is expediently arranged at the end of the handgrip.

Figure 2:
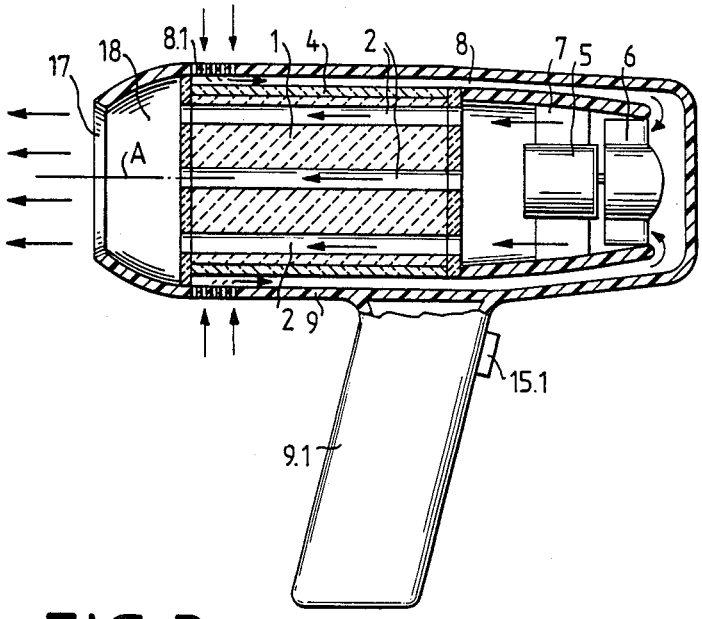
Figure 3:
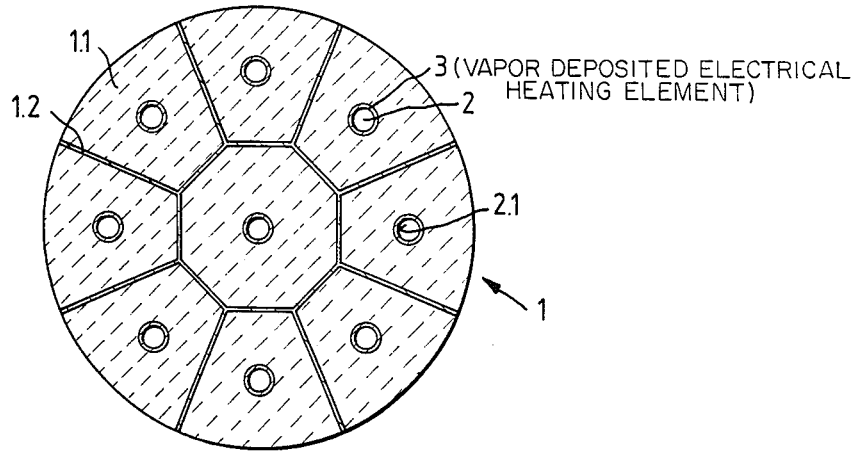

The drawings illustrate the subject matter of the instant invention by way of example of hand held hair dryers equipped therewith. In partially greatly simplified diagrammatic views in the drawings, FIG. 1 is the cross-section of an inventive hand held hair dryer in its charging position, where the hair dryer is connected with a power supply unit via the plug assembly integrated into its so-called pistol-grip, FIG. 2 is a hand held hair dryer where the intake air—as explained above—is directed to the fan according to the counterflow principle, FIG. 3 is a cross-section, presented on a larger scale, through an inventive heat-accumulator heater element.

Figure 4:
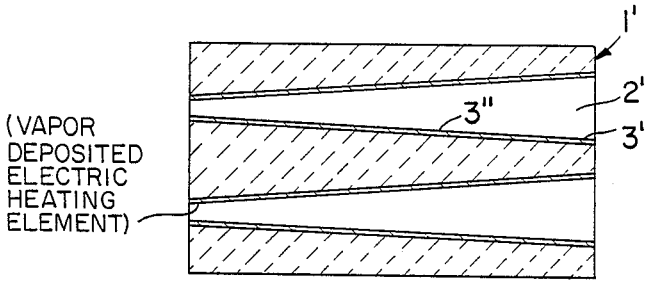

FIG. 4 is a cross section through the heat accumulator element of a further embodiment in accordance with the invention.

As is shown in FIG. 1, the inventive hand held hair dryer comprises a heat-accumulator heater element 1 enclosed by a heat-insulating sheath 4 and penetrated by several air ducts 2 in the direction of its longitudinal axis A. The fan includes a low-voltage direct-current motor 5, a fan wheel 6 and a guide wheel 7 urges the air sucked in through the inlet grill 8.1 through the air ducts 2. After the single air streams have been heated in the air ducts 2, they are conveyed to the mixing chamber 18 in which they are intimately mixed by turbulence so that the air stream exiting from the discharge opening 17 will have a uniform temperature distribution over its cross-section.

The appliance housing 9 possesses a so-called pistol-grip 9.1 accommodating the rechargeable batteries 14 serving for supply of the fan motor as well as a switch 15 enabling through its actuator 15.1 to set the various operating conditions of the appliance. At its frontal end, the grip 9.1 comprises two pairs of plugs 10 and 11, only one plug thereof being visible, the said plugs allowing the hand held hair dryer to be brought into electric contact with corresponding pairs of sockets 12 and 13 of the battery charger 16 by insertion of the dryer's grip 9.1 into a corresponding recess in the battery charger 16. For the sake of clarity of the illustration, the whole inner wiring of the appliance has been omitted, and it has likewise been dispensed with to display the electric resistance heater elements of the heat accumulator 2.

In the embodiment illustrated in FIG. 2, the cold-air inlet grill 8.1 has been shifted to the area of the discharge opening 17 of the appliance so that the air is conveyed to the fan unit 5, 6, 7 through the intake duct 8 annularly enclosing the heater element.

FIG. 3 illustrates a cross-section through a preferred embodiment of the heat-accumulator heater element which has already been referred to hereinabove. Herein, the heater element is composed of nine segments 1.1 containing one air duct 2 each, the butt joints thereof being filled by a compensating matter 1.2. The electric resistances for heating the heat-accumulator segments 1.1 have the form of preferably vapour-deposited coatings 3 in this embodiment illustrated. To reduce the flow resistance, the wall surfaces 2.1 of the air ducts 2 are furnished with a smooth coating which, above all, is composed of a varnish or a glaze.

In another embodiment, air ducts 2′ may have cross-sections that taper or narrow from the air intake side to the air outlet side of the heater element (as illustrated in FIG. 4). In that embodiment, the electrical resistance heaters are preferably in the form of vapor deposited coatings 3′ with a smooth coating 3″.

We claim:

1. A portable hairdressing appliance operable independently of an external electrical power supply, said appliance including a housing having an air inlet and an air outlet and being capable of being hand-held, structure in said housing receiving a rechargable battery, a heater structure, a fan wheel structure and a battery-powered electric motor in said housing arranged to be energized by the battery, said fan wheel structure being arranged to be driven by said motor to apply an air stream to said heater structure, said heater structure including an elongated heat accummulator structure made of a material of high specific heat, and being penetrated in the longitudinal direction by a plurality of air ducts, each said air duct having an air intake communicating with the housing air inlet, an air outlet communicating with the housing air outlet and electrical heating conductor structure in the form of a layer of electric resistance material on the wall of each said air duct in heat exchange relationship with said heat accumulator structure, said fan wheel structure being arranged to draw air into said housing through said housing air inlet and to blow said air through said air ducts for discharge through said housing air outlet, and detachable electrical plug structure for energizing said heating conductor structure from an external power supply to preheat said heat accumulator structure.

2. The appliance as claimed in claim 1, characterized in that the number of air ducts is 5 to 10.

3. The appliance of claim 1 wherein the inside diameter of each of said air ducts is in the range of 5 to 10 millimeters.

4. An appliance as claimed in claim 1, wherein the heat accumulator structure is encompassed by a heat-insulating sheath, at the outer side of which within the appliance housing is defined at least one intake passage through which cold air sucked in through said housing air inlet by said fan wheel structure is conveyed to the air-intake side of said fan wheel structure in opposition to the direction of flow through said air ducts.

5. A appliance as claimed in any one of the claims 1 to 3, wherein the air ducts (2) are arranged over the cross-section of the heat accumulator structure such that approximately the same quantity of heat-accumulating material is allocated to each air duct.

6. A appliance as claimed in claim 5, wherein the heat accumulator structure is subdivided into a number of segments of roughly like bulk containing one air duct each, the number of said segments corresponding to the number of said air ducts.

7. A appliance as claimed in claim 6, wherein the butt joints between the segments are filled with a compensating matter.

8. An appliance as claimed in any one of the claims 1 to 3, wherein the air ducts have a cross-section narrowing from the air intake to the air outlet thereof.

9. An appliance as claimed in any one of the claims 1 to 3, wherein the heat accumulator structure contains air ducts which extend in a straight line in the direction of its longitudinal axis.

10. An appliance as claimed in any one of the claims 1 to 3, wherein said plug structure is integrated in said housing and can be connected to a corresponding plug socket of a power supply unit for the purpose of energizing said heating conductor structure in said heat accumulator structure and for charging the battery.

11. An appliance as claimed in claim 10, wherein said plug structure includes a pair of plug contacts is provided on said housing for heating the heat accumulator structure by means of main voltage as well as a second pair of plug contacts for charging the battery by means of a suitable direct current voltage generated in the power supply unit.

12. A appliance as claimed in claim 10, wherein said housing has a so-termed pistol-grip, and in that said plug structure is arranged at the end of the grip.

13. A appliance as claimed in claim 1 or 4, wherein the resistance layer (3) is produced by vapor deposition.

14. A appliance as claimed in any one of the claims 1 to 4, wherein the walls of the air ducts have a smooth surface layer composed in particular of a glaze.

15. An appliance as claimed in any one of the claims 1, 2 or 4, wherein a mixing chamber is arranged between said heat accumulator structure and said housing air outlet, into which mixing chamber the outlet of said air ducts terminate.

16. A portable hairdressing appliance operable independently of an external electrical power supply, said appliance including a housing having an air inlet and an air outlet and being capable of being hand-held, structure in said housing receiving a rechargable battery, a heater structure, a fan wheel structure and a battery-powered electric motor in said housing arranged to be energized by the battery, said fan wheel structure being arranged be driven by said motor to apply an air stream to said heater structure, said heater structure including an elongated heat accummulator member of a material of high specific heat, and being penetrated in the longitudinal direction by a plurality of air ducts, each said air duct having an air intake communicating with the housing air inlet, an air outlet communicating with the housing air outlet and electrical heating conductor structure in the form of a layer of electric resistance material on the wall of each said air duct in heat exchange relationship with said heat accumulator member, a heat insulating sheath in said housing surrounding said accumulator member, structure in said housing defining an intake duct outside said sheath and communicating with said housing air inlet and said fan wheel structure through which cold air is sucked by said fan and conveyed in the opposite direction through said air ducts to a mixing chamber and said housing air outlet through which heated air is discharged.

17. A portable hairdressing appliance operable independently of an external electrical power supply, said appliance including a housing having an air inlet and an air outlet and pistol-grip structure capable of being hand-held, a rechargable battery in said housing, a heater structure, a fan wheel structure and a battery-powered electric motor in said housing arranged to be energized by said battery, said fan wheel structure being arranged to be driven by said electric motor to apply an air stream to said heater structure, said heater structure including an elongated heat accumulator structure made of a material of high specific heat, and being penetrated in the longitudinal direction by a plurality of air ducts, each said air duct having an air intake communicating with the housing air inlet, an air outlet communicating with the housing air outlet and electrical heating conductor structure in the form of a layer of electric resistance material on the wall of each said air duct in heat exchange relationship with said heat accumulator structure, a detachable electrical plug assembly in said pistol-grip structure for connection to a corresponding power supply unit, said plug assembly including a first plug contact structure connected to said electrical heating conductor structure for energizing said layer of electric resistance material prior to use to preheat said heat accumulator structure and second plug contact structure for charging the battery by means of suitable direct current energy generated in the power supply unit.

18. A portable hairdressing appliance operable independently of an external electrical power supply, said appliance comprising a housing that is capable of being hand-held and that includes structure defining an air inlet opening, and structure defining an air discharge opening, a heater structure, a fan wheel structure, a battery-powered electric motor, and structure receiving a rechargable battery in said housing for energizing said motor, said fan wheel structure being connected in driven relation to said electric motor and being arranged to apply an air stream to said heater structure, said heater structure including an elongated heat accumulator member of a material of high specific heat, said heat accumulator member having an air inlet side and an air outlet side and being penetrated in the longitudinal direction by a plurality of air ducts that communicate with said housing air inlet opening and through which said air stream is flowed by said fan wheel structure for exhaust through said housing air discharge opening, said air ducts having cross sections that decrease from said air inlet side to said air outlet side of said heat accumulator member; each said air duct having electrical heating conductor structure in the form of a layer of electric resistance material on disposed along its wall in heat exchange relationship with said heat accumulator structure, and detachable electrical plug structure for energizing said heating conductor structure from an external power supply to preheat said heat accumulator structure.

* * * * *